United States Patent [19]

Tucker

[11] 3,974,038

[45] Aug. 10, 1976

[54] COKE OVEN DOOR

[75] Inventor: Linwood G. Tucker, Pittsburgh, Pa.

[73] Assignee: Koppers Company, Inc., Pittsburgh, Pa.

[22] Filed: Dec. 22, 1971

[21] Appl. No.: 210,704

[52] U.S. Cl. ..... 202/248; 110/173 R

[51] Int. Cl.[2] ..... C10B 1/06; C10B 25/06

[58] Field of Search ..... 202/248, 247; 110/173, 110/175, 176, 177

[56] References Cited

UNITED STATES PATENTS

| | | | |
|---|---|---|---|
| 2,442,348 | 6/1948 | Exum | 202/248 |
| 3,505,174 | 4/1970 | Peterson et al. | 202/248 |
| 3,510,404 | 5/1970 | Freund | 202/248 |
| 3,711,380 | 1/1973 | Teplitz | 202/248 |

*Primary Examiner*—Norman Yudkoff
*Assistant Examiner*—J. Sofer
*Attorney, Agent, or Firm*—Sherman H. Barber; Oscar B. Brumback; Olin E. Williams

[57] ABSTRACT

A coke oven door, having a sealing ring that coacts with a plurality of spring plungers, is provided with a plurality of equalizing pads located between the top and bottom latches to ensure that the sealing ring is seated at these locations. Also the sealing ring is installed in slots in the door frame which are open at both ends.

1 Claim, 7 Drawing Figures

COKE OVEN DOOR

BRIEF SUMMARY OF THE INVENTION

The present invention relates to coke ovens generally, and, more particularly, to an improved coke oven door of the self-sealing type.

A principal difficulty in sealing the doors of a coking chamber is providing and maintaining a good metal-to-metal contact between the door jamb and a sealing ring or knife edge attached to the door.

According to the present invention, an improved coke oven chamber door comprises a relatively flexible door frame. A peripheral sealing ring is set into slots or grooves that are cut in the door frame and that are open at both ends. Between the top and bottom latches, there are on each long side of the door a plurality of equalizing pads that coact with the sealing ring to ensure proper seating of the sealing ring on the door jamb.

For a further understanding of the invention and for features and advantages thereof, reference may be made to the following description and the drawings which illustrate a preferred embodiment of equipment in accordance with the invention.

DETAILED DESCRIPTION

Figure 1:
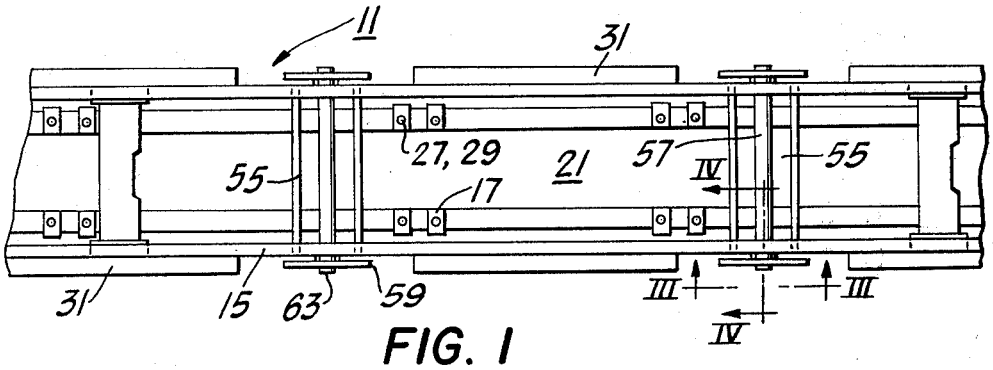
FIG. 1 is a schematic, simplified plan view of a portion of a door in accordance with the invention.

Referring to FIG. 1, a portion of a coke oven door 11 in accordance with the invention is illustrated in a simplified manner. That is, much detailed structure which is known to those skilled in the art, but which forms no part of the invention, is omitted.

Figure 2:
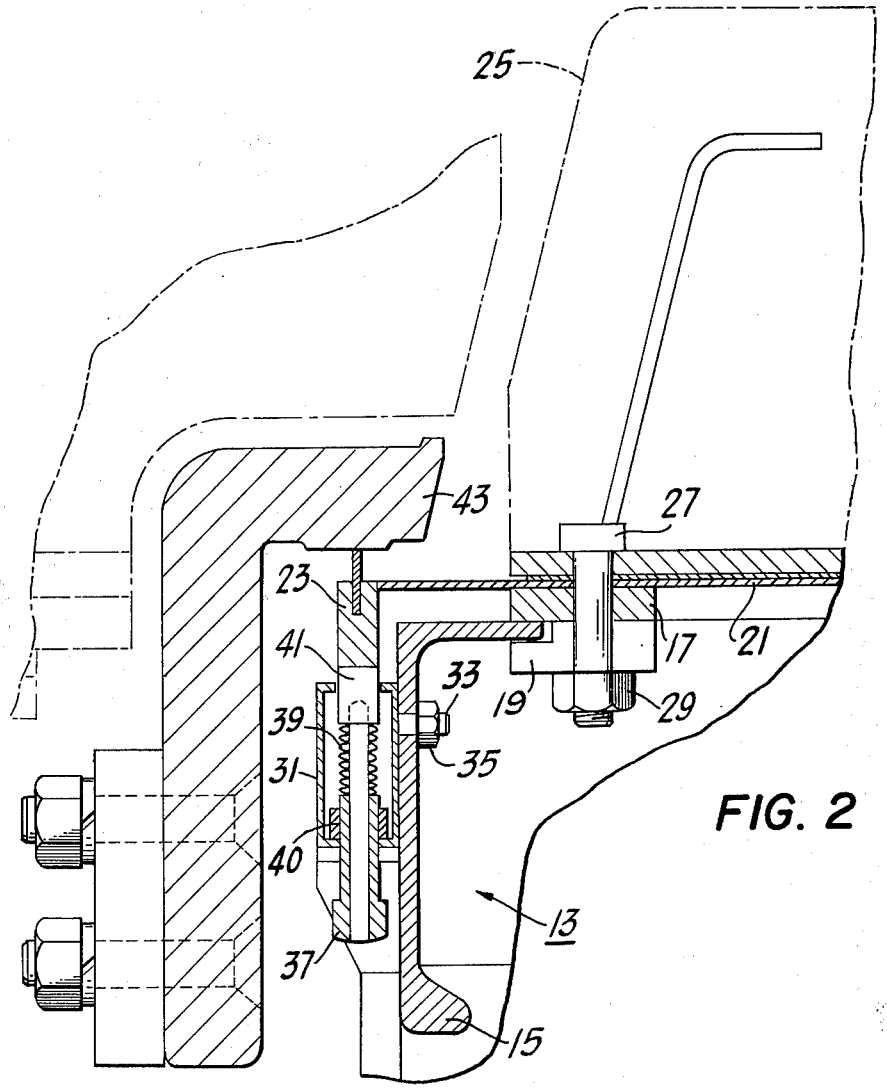
FIG. 2 is a sectional view of a portion of the door of FIG. 1 and a door jamb.

The door 11 has a door frame 13, shown in larger detail in FIG. 2, that includes a bulb angle 15. A hanger bar 17 and a clamp 19, a thin panel 21 with its peripheral edges attached as by welding to a sealing plate assembly 23, and a door plug assembly 25 that is secured to the panel 21 by means of conventional bolts 27 and nuts 29, are associated with the bulb angle 15.

A plurality of spring boxes 31 are secured to the web portion of the bulb angle 15 by means of studs 33, that are welded to the box 31, and nuts 35. The spring boxes 31 are arranged in spaced apart relation, as suggested in FIG. 1, around the entire periphery of the door frame 13.

Each spring box 31 contains a plurality of adjusting screws 37, each of which is surrounded by and coacts with a spring 39; the adjusting screw 37 being threaded as to 40 into the spring box 31 wall structure.

The spring 39 acts on the adjusting screw 37, and it also acts on a plunger 41 that coacts with and urges the sealing plate assembly 23 toward and into contact with a door jamb 43.

Figure 5:
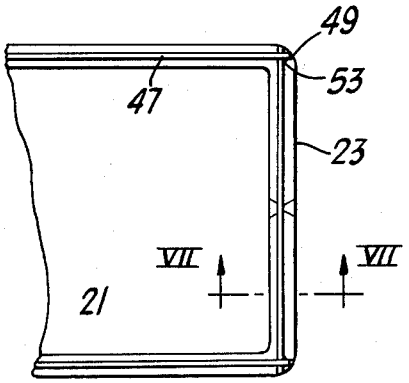
FIG. 5 is a schematic, simplified view of the sealing plate assembly portion of the door of FIG. 1.
Figure 6:
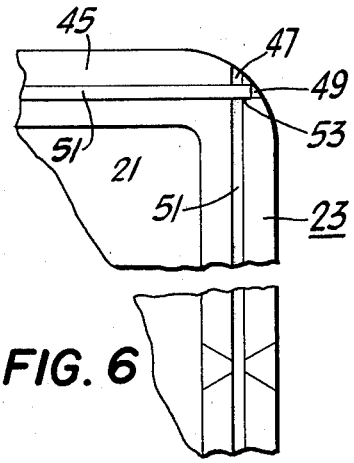
FIG. 6 is an enlarged view of a portion of the structure shown in FIG. 5.
Figure 7:
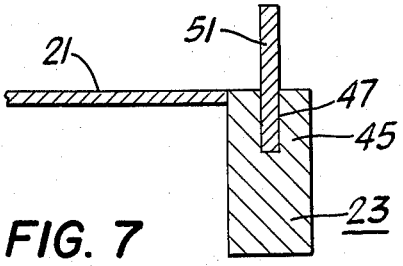
FIG. 7 is a view along line VII—VII of FIG. 5.

The sealing plate assembly 23 includes an elongate, continuous, rectangular bar 45 which has in one surface a groove 47. It will be noted from FIGS. 5 and 6 that the groove 47 in the bar 45, on the long sides of the door, is open at both ends; one such open end 49 being shown in FIGS. 5 and 6. Likewise the groove 47 in the bar 45, on the short sides of the door, is also open at the ends, as shown in FIGS. 5 and 6.

The seal plate assembly 23 also includes a thin rectangular sealing bar 51 that fits into the grooves 47 in the rectangular bar 45. It will be noted from FIGS. 5 and 6 that the thin rectangular sealing bars 51 are arranged in end adjacent relation with the bars in the long side grooves 47 overlapping the ends of the thin rectangular bars 51 in the short side grooves 47. The ends of the overlapping bars are or may be welded as at 53 to provide a seal against air passing through the space between the abutting bars into the coke oven chamber.

Figure 4:
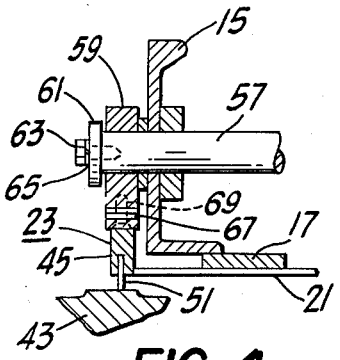
FIG. 4 is a view along line IV—IV of FIG. 1 and of FIG. 3.

The bulb angle door frame 15 also carries two pairs of side stops 55, each one of which includes a round bar 57 that spans the width of the door 11, as shown in FIG. 1, and that extends slightly beyond the bulb angle web, as shown in FIG. 4.

Figure 3:
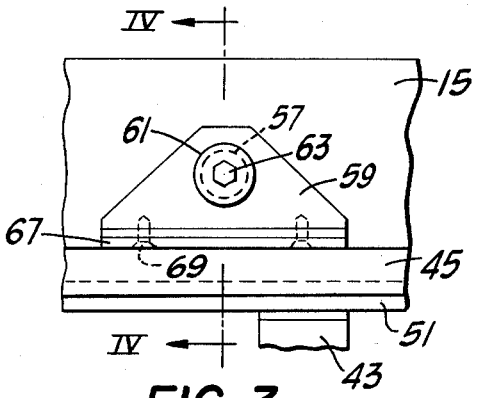
FIG. 3 is a view along line III—III of FIG. 1.

To the outwardly extending portion of the round bar 57 there is pivotally mounted a side stop 59, having a generally trapezoidal shape, as shown in FIG. 3. An end cap 61, with cap screw 63 and lock washer 65 that is threaded into the round bar 57, holds the side stop 59 in place.

A shoe of suitable gasket-type material 67 is secured to the bottom surface of the side stop 59 by means of screws 69, so that from time to time the shoe 67 can be removed and replaced. The shoe 67, comprising one or more layers of gasket material, contacts the sealing plate assembly 23 and exerts a force provided by the side stops 59 over a broader area than that provided by the spring plungers 41; particularly, in the region of the door jamb which is subjected to and suffers the greatest distortion from heat.

From the foregoing description of one embodiment of the invention, those skilled in the art should recognize many important features and advantages of it, among which the following are particularly significant:

That the side stops, acting over a finite area of the sealing plate assembly, urge the sealing bar toward and into broad contact with the door jamb; and That the sealing bars are inserted into slots in the rectangular bar of the assembly and that these slots are open at the ends to allow for thermal expansion of the sealing bars.

Although the invention has been described herein with a certain degree of particularity it is understood that the present disclosure has been made only as an example and that the scope of the invention is defined by what is hereinafter claimed.

What is claimed is:

1. In a coke oven door, the improvement comprising:

a. a rectangular door frame supporting a sealing assembly including:

1. an elongate bar encompassing said door frame and having a groove in each one of the longer sides of said elongate bar and a groove in each one of the shorter sides of said elongate bar, with the said grooves intersecting at the corners of said frame; and
2. a sealing bar in each groove with the ends of the sealing bars in the grooves of one pair of opposite sides at said corners overlapping the ends of the sealing bars in the grooves of the other pair of opposite sides.

b. a plurality of side stops mounted to said door frame, each said stop comprising:

1. a plate member pivotally mounted to said door frame; and 2. a replaceable shoe attached to said plate, with said plate and said shoe coacting with one of said elongate bars.

* * * * *